United States Patent [19]

Asanuma et al.

[11] Patent Number: 4,982,691

[45] Date of Patent: Jan. 8, 1991

[54] DEVELOPING DEVICE FOR ELECTROPHOTOGRAPHIC APPARATUS HAVING MAGNET ROLLERS

[75] Inventors: Masato Asanuma; Masatoshi Kaneshige; Toyoka Aimoto, all of Nara, Japan

[73] Assignee: Sharp Kabushiki Kaisha, Osaka, Japan

[21] Appl. No.: 334,099

[22] Filed: Apr. 5, 1989

[30] Foreign Application Priority Data

Apr. 5, 1988 [JP] Japan ..... 63-83945
Apr. 5, 1988 [JP] Japan ..... 63-83947
May 10, 1988 [JP] Japan ..... 63-112764

[51] Int. Cl.[5] ..... G03G 15/09

[52] U.S. Cl. ..... 118/658; 355/251; 355/253

[58] Field of Search ..... 355/245, 251, 253; 118/657, 658

[56] References Cited

U.S. PATENT DOCUMENTS 4,044,719 8/1977 Ohmori ..... 355/253 X
4,699,079 10/1987 Palm et al. ..... 118/658

FOREIGN PATENT DOCUMENTS 56-101168 8/1981 Japan ..... 118/657
56-53410 12/1981 Japan .
57-211178 12/1982 Japan ..... 355/253

*Primary Examiner*—Joan H. Pendegrass
*Attorney, Agent, or Firm*—Flehr, Hohbach, Test, Albritton & Herbert

[57] ABSTRACT

A developing device for an electrophotographic apparatus includes a developing magnet roller, a transfer magnet roller and a separator for separating these rollers. Each of these rollers has a sleeve which is rotatably fitted around a columnar magnet piece. Between the sleeve of the developing magnet roller and the separator is a gap which is greater than the thickness of a developer layer formed on a surface of the sleeve of the developing magnet roller.

6 Claims, 7 Drawing Sheets

DEVELOPING DEVICE FOR ELECTROPHOTOGRAPHIC APPARATUS HAVING MAGNET ROLLERS

FIELD OF THE INVENTION

This invention relates to a developing device for an electrophotographic image forming apparatus such as a copying machine and a laser printer and, more particularly, to such a developing device having magnet rollers for developing an electrostatic latent image on a photoconductor and for transferring developer particles and a separator disposed between these rollers.

There are known electrophotographic image forming apparatus such as copying machines which make use of toner including color pigments. With such an apparatus, electromagnetic images are developed not only in black but also in various colors by using toners of different colors and by selecting one of a plurality of developing units incorporating these toners.

To produce a full color image with such an apparatus, use may be made, for example, of cyan, magenta, yellow and black developing units, each using toner of a different color. A color image on an original document is color-separated by means of a plurality of color filters and a color-separated image thus obtained is projected onto a photoconductive medium to form thereon an electrostatic latent image. This latent image is then developed into a visible toner image of a selected color. After this process is repeated for all colors, a full color image is produced on the photoconductor.

To selectively apply toner particles of a specified color, it is essential to operate the developing units independently, that is, when one of them is being used, it must be made certain that the other developing units do not apply their toner particles onto the photoconductor at the same time. According to a prior art technology for this purpose, the so-called developing gap, which is the distance between the photoconductor and the developing part of a developing unit, is made variable such that those of the units not applying toner onto the photoconductor are moved farther away therefrom. When the developing gap of a developing unit is changed, however, fluctuations occur in the developing conditions, causing a variation in the image density. If the developing gap is not accurately set, furthermore, it cannot be hoped to obtain a normal color image.

On the other hand, there is known a kind of image forming apparatus adapted to magnetically form a brush-like formation of developer particles on the surface of a magnet roller. An apparatus of this type is normally designed with magnet poles positioned such that the contact between this brush-like formation and the photoconductor can be prevented when it is so desired. If the magnetic poles are not properly positioned in an apparatus of this type particularly when a two-component developer is used, however, not only does a variation in the image density result but also the carrier may be deposited on the photoconductor, thereby adversely affecting the image quality.

In view of the above, it has been proposed that a shutter be provided in each channel leading to a developing part such that the supply of developer through each channel can be controlled by opening and closing this shutter, depending on whether the associated developing device is being used or not. With a shutter like this, there is no need to vary the developing gap and the developing device can be switched between a developing condition wherein developing particles can pass through the channel and a non-developing condition wherein toner particles are prevented from approaching the electrostatic latent image on the photoconductor.

In the case of an apparatus of the aforementioned type forming a brush-like formation of developer particles, there is provided a so-called developing magnet roller having a sleeve rotatably fitted around the outer periphery of its columnar magnet piece and disposed opposite to the photoconductor. Also provided is a so-called transfer magnet roller similarly having a sleeve rotatably fitted around the outer periphery of its columnar magnet piece and disposed near the developing magnet roller for receiving used developer particles therefrom and recirculating them inside the developing device. A separator is provided between these magnet rollers in such a way that the gap it forms with the developing magnet roller is small and the developer particles attached to the sleeve of the developing magnet roller can be easily scraped.

Within a prior art developing device thus structured, pressure is generated to a significant degree on the developer particles due to sudden changes in the direction of their flow as they are transferred from the developing magnet roller to the transfer magnet roller. Such pressure is known to frequently cause an excessive stress and hence early deterioration of the developer in the region surrounded by the two magnet rollers and the separator.

Developer particles which are picked up by the magnetic force of the developing magnet roller are transferred by the transfer magnet roller to a stirring roller but it is very important to correctly determine the position of the transfer magnet roller with respect to a scraper provided for the purpose of scraping off developer particles therefrom. If the tip of the scraper is too far away from a magnetic pole (developer release pole) on the outer periphery of the transfer magnet roller for the purpose of releasing the developer particles therefrom, the scraper cannot effectively scrape off the attached particles. The particles which were not scraped off by the scraper will pass through a gap of typically about 0.2 mm between the scraper and the transfer magnet roller. This contributes rather severely to early deterioration of the particles due to an increased stress thereon.

Some prior art developing devices of this type are designed such that a brush-like formation of developer particles is formed on the transfer magnet roller but the amount of developer particles that can be scraped off is not sufficiently large. Since the developer particles form a flat layer between the poles, furthermore, they cannot be scraped off efficiently even if a scraper is made use of. If the magnetic force of the aforementioned magnetic pole is increased, this will only make it harder to efficiently scrape of the particles. The portion of the developer particles which are not scraped off the transfer magnet roller will pass through the gap of about 0.2 mm in width formed between the scraper and the transfer magnet roller. Such particles are rather badly stressed and deteriorated as a result.

If the developer is of a two-component kind composed of toner and a carrier, the carrier is subject to deterioration and must be replenished periodically such that images of a good quality can be obtained. When it is desired to remove used developer particles, the developing and transfer magnet rollers are rotated such that the particles remaining in the tank are magnetically attracted and picked up by the developing magnet roller and discarded from the developing tank through an opening at the top. If the developer particles form a flat layer in the area between two adjacent poles on the transfer magnet roller as mentioned above, however, the residual developer particles cannot be efficiently scraped off and a large amount of deteriorated developer particles will remain inside the developer tank.

If a large quantity of deteriorated developer particles remained inside the tank, they would be mixed with the fresh supply and there would cause the image density to drop and adversely affect the image quality.

SUMMARY OF THE INVENTION

It is a primary object of this invention to provide a developing device for an electrophotographic apparatus such as a copying machine having a developing magnet roller, a transfer magnet roller and a separator disposed therebetween such that developer particles being circulated therethrough are not unduly stressed in the region surrounded by the magnet rollers and the separator.

Another object of this invention is to provide a developing device as described above which also has a scraper formed on the separator such that the gap between the scraper and a sleeve rotatably fitted around the transfer magnet roller becomes filled with a brush-like formation of developer particles magnetically formed on the transfer magnet roller such that the developer particles on this roller can be efficiently scraped off by the scraper.

Still another object of this invention is to provide a developing device as described above, having a continuous area on the transfer magnet roller on which the brush-like formation remains formed such that the developer particles magnetically attracted to the transfer magnet roller can be efficiently scraped off.

A further object of this invention is to provide a developing device as described above, from which used developer particles can be efficiently removed such that, when it is attempted to replace the developing particles with a new supply, the newly supplied developer particles are not mixed with the residual particles.

The above and other objects of the present invention can be achieved by providing a developing device for an electrophotographic apparatus comprising a developing magnet roller having a sleeve rotatably fitted around the cylindrical outer periphery of a columnar magnet piece and disposed opposite to a photoconductor for having an electrostatic latent image formed thereon, a transfer magnet roller having a sleeve rotatably fitted around the cylindrical outer periphery of a columnar magnet piece and positioned near the developing magnet roller for receiving used developer particles therefrom and transferring them away therefrom, and a separator disposed between these two magnet rollers, these components being so arranged that the gap formed between the separator and the sleeve of the developing magnet roller s larger than the thickness of the layer of developer particles not having been transferred away from the developing magnet roller. With this gap thus made larger than the particle thickness, the pressure generated by sudden changes in the direction of flow of the developer particles can be released effectively therethrough and the particles within the region surrounded by the two magnet rollers and the separator are not subjected to a excessive stress.

In one aspect of the present invention, a developing device as described above also comprises a scraper for scraping developer particles off the surface of the transfer magnet roller and the transfer magnet roller has on its outer periphery a magnetic pole for releasing developer particles (developer release magnetic pole). The scraper has a tip which is located within the area on the surface of the transfer magnet roller where the developer particles are magnetically caused by the developer release magnetic pole to form a brush-like formation. If the magnetic force of this pole is no greater than 500 gauss, the tip of the scraper should preferably be within $\pm 10°$ of the developer release magnetic pole. With a device thus structured, the gap between the scraper and the sleeve of the transfer magnet roller is sealed by the brush-like formation of developer particles such that the developer particles are transferred by the transfer magnet roller without passing through the gap and hence can be dependably scraped off especially if the strength of the developer release magnetic pole is no greater than 500 gauss. The particles thus scraped off the transfer magnet roller are not highly stressed and recycled back to the developing magnet roller.

In another aspect of the present invention, a developing device as described above also has a so-called developer transfer magnetic pole on the upstream side of the developer release magnetic pole with respect to the direction of flow of the developer particles on the transfer magnet roller. The angular separation between these two poles is such that the brush-like formation of developer particles magnetically formed on the transfer magnet roller remains substantially continuously. According to one embodiment of the present invention, the magnetic strength of these two poles is approximately 500 gauss, the outer diameter of the transfer magnet roller is 35 mm and the angular separation of these two poles is less than 40°. With the brush-like formation thus formed substantially continuously between these two poles on the transfer magnet roller, the developer particles thereon can be effectively scraped off by the scraper. Substantially no developer particles pass through the gap between the scraper and the transfer magnet roller and the stress caused on the developer particles can be reduced. When it is desired to replace used developer particles with a fresh supply, residual particles can thus be removed more dependably.

BRIEF DESCRIPTION OF THE DRAWINGS

The accompanying drawings, which are incorporated in and form a part of the specification, illustrate embodiments of the present invention and, together with the description, serve to explain the principles of the invention. In the drawings.

DESCRIPTION OF THE EMBODIMENTS

In what follows, a copying machine is described with reference to FIGS. 1–8 as an example of image forming apparatus embodying the present invention.

Figure 2:
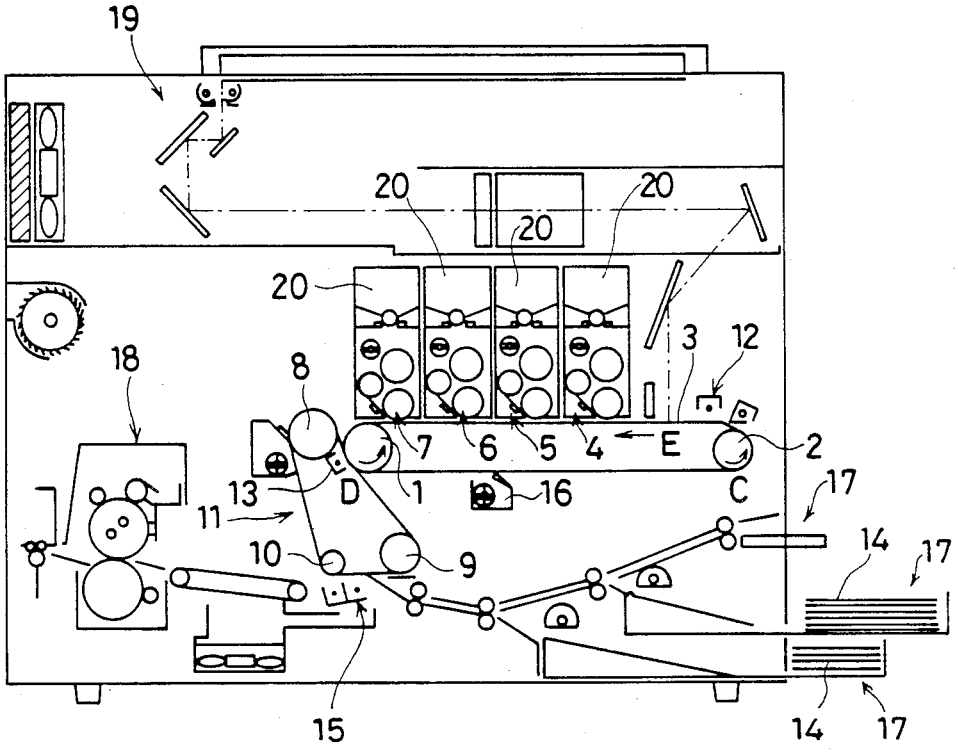
FIG. 2 is a schematical front sectional view of a copying machine which incorporates developing units of the kinds shown in FIG. 1.

Inside a housing, as shown in FIG. 2, is provided a pair of driving rollers 1 and 2 at a predetermined distance therebetween. Between and around these driving rollers 1 and 2 there is set an endless belt-like photoconductor 3 for forming an electrostatic latent image. Above this photoconductor 3 there are provided a plurality of developing units 4–7 disposed opposite to the photoconductor 3. These developing units 4–7 can be switchably either in a developing condition or in a non-developing condition. Above these developing units 4–7 are containers 20 containing toner. Under the photoconductor 3 is a cleaning blade 16 in sliding contact with the photoconductor 3.

In the vicinity of the driving roller 1 are three rollers 8, 9 and 10 at predetermined distances from one another. Set around these three rollers 8, 9 and 10 is an intermediate transfer belt 11 which is another endless belt and is in contact with the photoconductor 3. In the vicinity of the other driving roller 2 is a main charger 12. In the vicinity of the roller 8 is a first transfer charger 13. A second transfer charger 15 is in the vicinity of and below the roller 10.

On one side of the copying machine at low positions are a plurality of paper feeders 17 for feeding copy paper sheets 14. On the other side of the copying machine at a low position is a fixing device 18 for fixing toner images formed on the copy paper sheets 14. At an elevated position inside the copying machine is an exposing device 19 which serves to form an electrostatic latent image on the photoconductor 3 by exposing it to light.

Since the developing units 4–7 are structured substantially alike, the structure of the developing unit 4 alone will be described in what follows.

Figure 1:
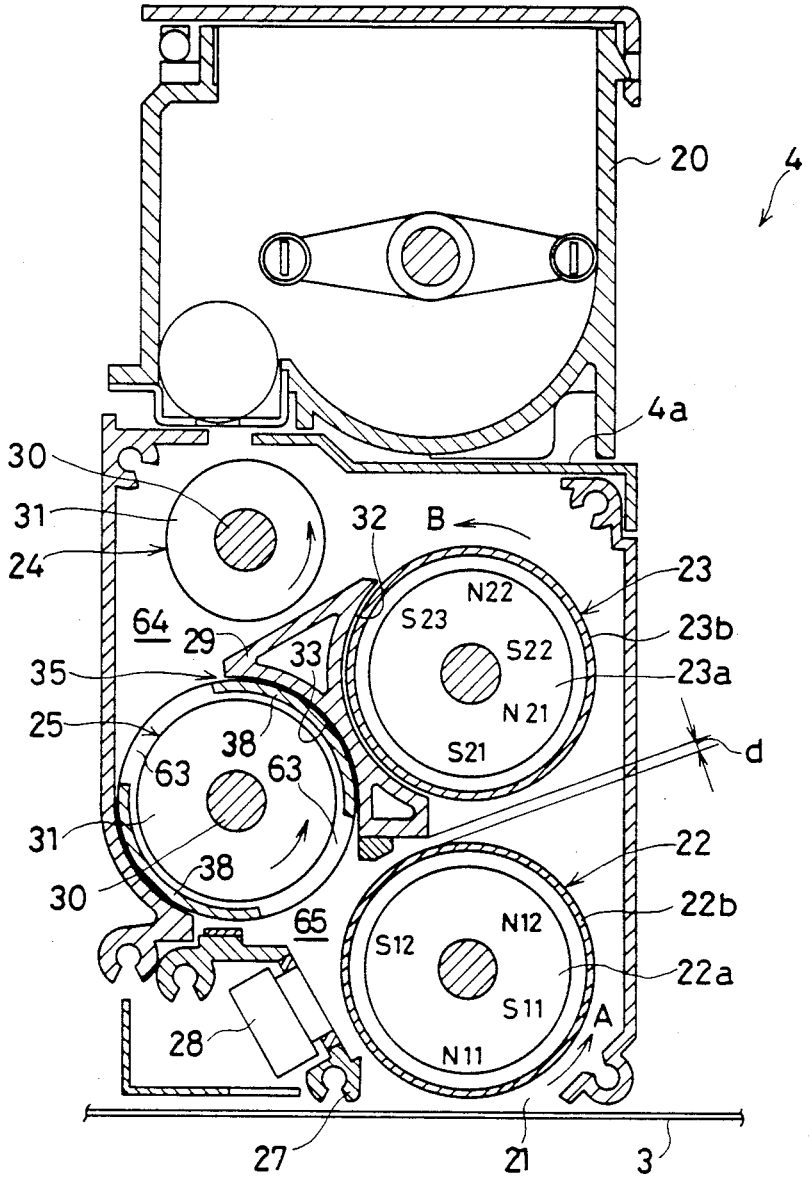
FIG. 1 is a vertical sectional view of a developing unit embodying the present invention, serving as a component of an electrophotographic apparatus.

As shown in FIG. 1, the developing unit 4 includes a developing magnet roller 22 which has a sleeve 22*b* rotatably fitted around the cylindrical outer periphery of a columnar magnet piece 22*a* and is disposed near an opening for transferring toner to the photoconductor 3 therethrough.

The columnar magnet piece 22*a* is affixed to a developer tank in the developing unit 4. The main N pole N11 of this magnet piece 22*a* is opposite to the photoconductor 3, and its S pole S11, a secondary N pole N12 and another S pole S12 are formed as shown in order in the direction of the arrow A. The sleeve 22*b*, which is rotatably fitted around the periphery of the magnet piece 22*a*, is made of a non-magnetic material such as aluminum and is also cylindrically shaped.

A transfer magnet roller 23 which, like the developing magnet roller described above, has a sleeve 23*b* rotatably fitted around the cylindrical outer periphery of a columnar magnet piece 23*a*, is provided above the developing magnet roller 22 for transferring the used developer in an upward direction from the developing magnet roller 22.

The columnar magnet piece 23*a* of the transfer magnet roller 23 is affixed to the developer tank and a magnetic pole S21 is formed at a position on its outer peripheral part adjacent to the developing magnet roller 22. Magnetic poles N21, S22, N22 (a developer transfer pole) and S23 (a release pole) are formed in this order on this magnet piece in the direction of the arrow B facing a developer transfer channel. The sleeve 23*b* is also made of a non-magnetic material such as aluminum and is cylindrically shaped.

The magnetic poles S21, N21, S22, N22, S23 are formed at positions facing the developer transfer channel around the transfer magnet roller 23. The developer release pole S23 serves to release the developer from the sleeve 23*b* and the developer transfer pole N22 is on the transfer channel on the downstream side of the developer release pole S23 (the direction of the developer transfer being shown generally by the arrow B). The angle subtended by these poles S23 and N22 at the center is determined such that the developer particles continuously maintain a brush-like formation by the attractive magnetic forces of the poles S23 and N22.

Figure 7:
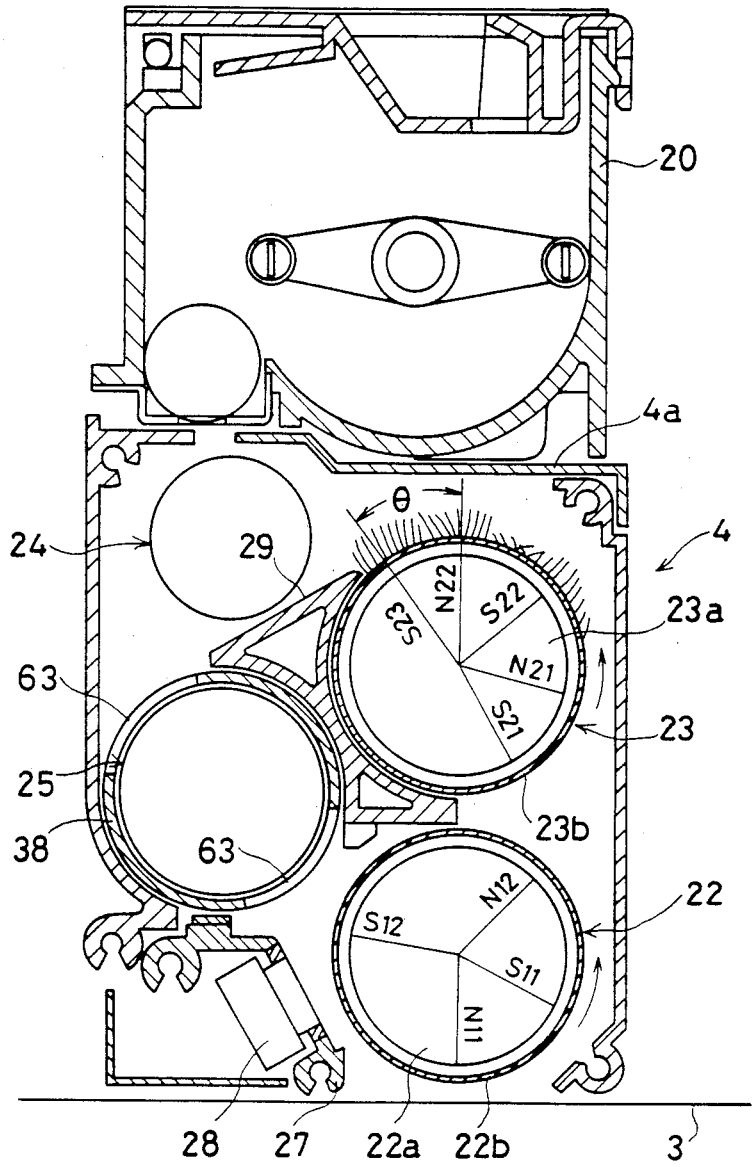
FIG. 7 is another vertical sectional view of a portion of the developing unit of FIG. 1 showing the brush-like formation of developer particles more in detail.

According to a particular embodiment of the present invention, the magnetic force of the poles S23 and N22 is 500 gauss, the outer diameter of the transfer magnet roller 23 is 35 mm, the angle Θ subtended by these two rollers as shown in FIG. 7 is equal to or less than 40°. With the roller 23 thus structured, the brush-like formation of developer particles is maintained between the positions of these poles S23 and N22.

Figure 6:
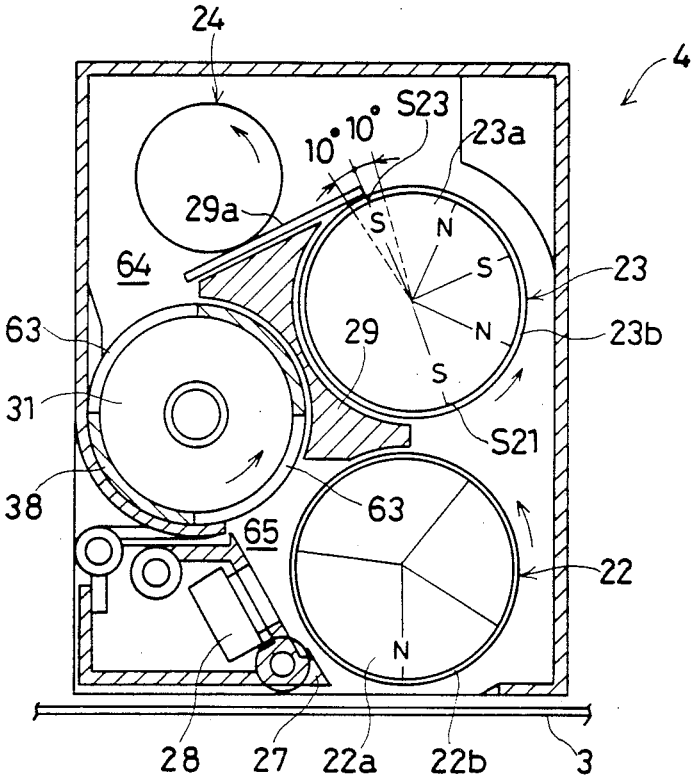
FIG. 6 is a vertical sectional view of a portion of the developing unit of FIG. 1 showing the scraper more in detail.

A scraper 29*a* for scraping developer particles off the roller 23 is provided as shown in FIG. 6 on an upper part of a separator 29 to be described in detail below. If the magnetic force of the poles S23 and N22 exceeds 500 gauss, however, it becomes difficult for the scraper 29*a* to scrape off the developer particles because the attractive magnetic force thereon to the roller 23 is too strong. It is preferable, therefore, that the magnetic force of these poles S23 and N22 be no greater than 500 gauss.

As mentioned above, the magnetic pole S21 of the transfer magnet roller 23 is at a position adjacent to the developing magnet roller 22. On the other hand, the pole N12 of the developing magnet roller 22 is at a position shifted somewhat in the direction opposite to the arrow A. The magnetic force of this pole N12 is no greater than that of the pole S of the transfer magnet roller 23.

A first stirring roller 24 for stirring the developer which is transferred by the transfer magnet roller 23 and the toner which is supplied from the supplementary container 20 in response to a signal from a toner density sensor 28 to be described below is provided diagonally above the transfer magnet roller 23. Diagonally below the transfer magnet roller 23 and below the first stirring roller 24, there is a second stirring roller 25 for stirring the developer which has already been stirred by the first stirring roller 24 and supplying the stirred developer to the developing magnet roller 22. Each of these stirring rollers 24 and 25 is provided with fins 31 spiraling around a central axis 30 as more clearly shown in FIG. 4. The central axis 30 is rotatably supported by the developing unit 4.

Figure 3:
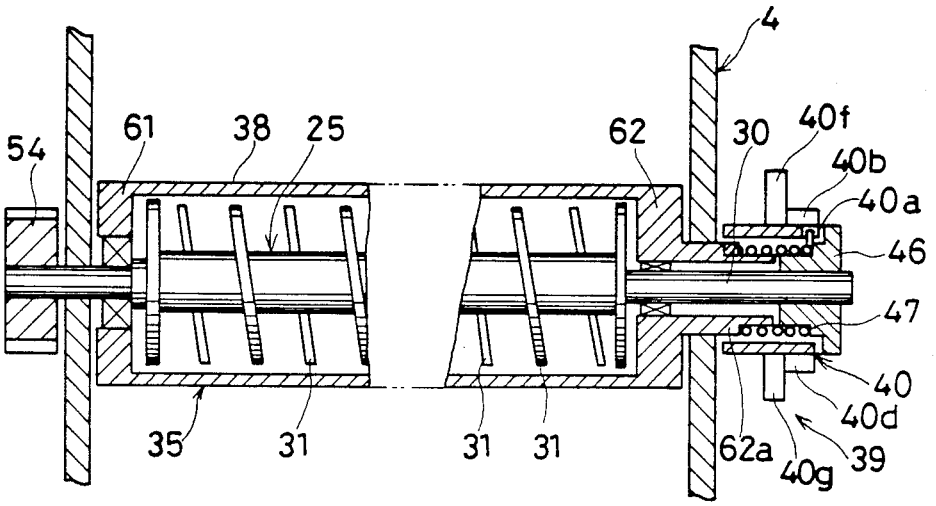
FIG. 3 is a vertical sectional view of the second stirring roller and the spring clutch which are parts of the developing unit shown in FIG. 1.
Figure 4:
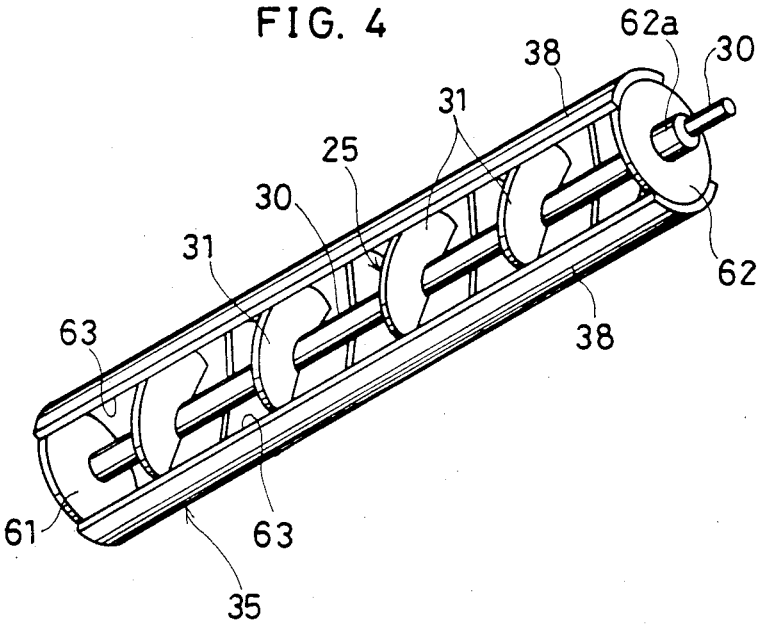
FIG. 4 is a perspective view of the second stirring roller shown in FIG. 1.

As shown in FIG. 3, the second stirring roller 25 has a protuberant part 46 at one end of its central axis 30 and a drive gear 54 at the other end. The stirring fins 31 and the protuberant part 46 are rotated by a driving force transmitted from a driving means (not shown) through the drive gear 54. As shown in FIG. 4, the second stirring roller 25 is provided with a shutter system 35 including flanges 61 and 62. Its central axis 30 penetrates these flanges 61 and 62 and is rotatably supported thereby. A pair of shutters 38, each having a cross-sectionally semicircular shape, is provided between these flanges 61 and 62. These shutters 38 are in point symmetry with respect to the central axis 30 such that slit-like apertures 63 are formed. An axially extended part **62*a* of the flange 62 is supported by the developer tank. A cylindrical clutch cover 40 for a spring clutch 39 is movably fitted between this axially extended part 62*a* and the outer periphery of the protuberant part 46 as shown in FIG. 3. One end of a coil spring 47 is affixed to a notch 40*a* provided at an end of the clutch cover 40. The other end of the coil spring 47 is secured to the axially extended part 62*a*. The inner diameter of this coil spring 47 is designed to be smaller than the outer diameters of the extended part 62*a* of the flange 62 and the protuberant part 46 when the coil spring is in its released condition. The coil spring 47 is pulled in its spiral direction by the rotary force which is exerted in a predetermined direction and transmitted from the driving means to the protuberant part 46 such that the internal diameter of the coil spring 47 is contracted so as to further tighten the protuberant part 46 and the extended part 62*a***.

When a selector 36 (to be described below) is operated such that the clutch cover 40 and the protuberant part 46 rotate together, the protuberant part 46 and the axially extended part **62*a* are tightened by the coil spring 47 and, therefore, the rotary force from the central axis 30 to the protuberant part 46 is transmitted to the flange 62 through the coil spring 47 and the extended part 62*a*. When the rotating motion of the clutch cover 40 is regulated, the contracting force of the coil spring 47 is reduced such that a slip occurs between the protuberant part 46 and the spring 47. As a result, the driving force of the axis 30 is no longer transmitted to the flange 62**.

Figure 5:
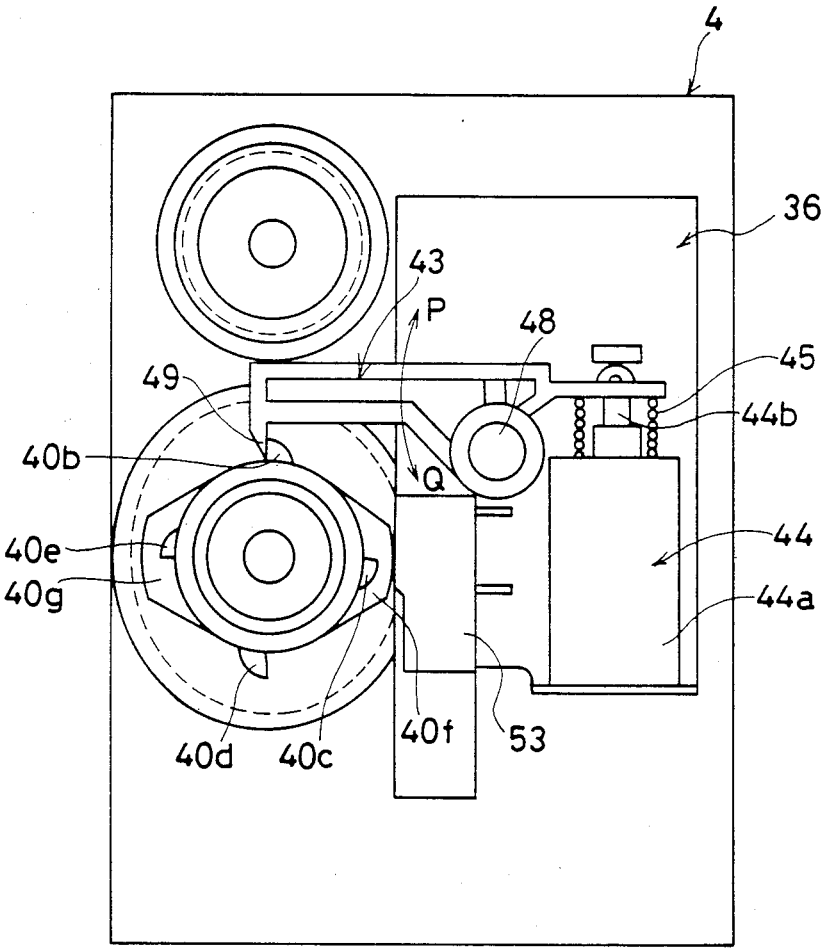
FIG. 5 is a front elevation of a mechanism embodying the present invention for operating the shutter system shown in FIG. 1.

As shown in FIG. 5, four claw pieces **40*b*–40*e* are provided symmetrically and at even angular intervals (of 90° each) around the outer periphery of the clutch cover 40. Two sheet-like protrusions 40*f* and 40*g* are provided in a point symmetry relationship with respect to the central axis 30 of the second stirring roller 25 adjacent to the claw pieces 40*b*–40*e* on the outer periphery of the clutch cover 40**.

The spring clutch 39 includes the axially extending part **62*a* of the flange 62, the protuberant part 46, the coil spring 47 and the clutch cover 40**.

The selector 36, which was referred to above, is provided in the developing unit 4 in an outwardly direction from the spring clutch 39 as shown in FIG. 5. The selector 36 serves to regulate the transmission of driving force (that is, whether it is transmitted or cut off), selectively opening and closing the shutter system 35. The selector 36 includes an arm 43, support axis 48, solenoid 44, spring 45 and rotational position detector switch 53. The arm 43 is provided at one end thereof with a stopper 49 which engages with one of claw pieces **40*b* and 40*e*, thereby stopping the rotation of a clutch cover 40. The support axis 48 is attached in the vicinity of the center of the arm 43 so as to rotatably support the arm 43. The solenoid 44 is comprised of a housing 44*a* and plunger 44*b*. The housing 44*a* draws the plunger 44*b* so that the arm 43 rotates in a direction in which the stopper 49 disengages from one of the claw pieces 40*b* to 40*e*. The spring 45 is positioned between the arm 43 and the housing 44*a* in such a way that the spring 45 is able to be deformed. When the force for drawing the plunger 44*b* is released, the stopper 49 pushes back the arm 43 in a direction in which the stopper 49 engages with one of the claw pieces 40*b* to 40*e*. The rotational position detector switch 53 is disposed in the vicinity of the clutch cover 40 and has a movable piece (not shown). When one of the sheet-like protrusions 40*f*, and 40*g*, which are disposed at the outer periphery of the clutch cover 40, presses the movable piece, the rotational position detector switch 53** is turned ON to detect whether the shutter is in its open or closed condition.

As shown in FIG. 1, the separator 29 (briefly referred to above) is disposed so as to mutually separate the developing magnet roller 22, the transfer magnet roller 23, the first stirring roller 24 and the second stirring roller 25. A gap d is maintained between the separator 29 and the sleeve **22*b* of the developing magnet roller 22 such that d is not less than the thickness of the developer layer formed on the surface of the sleeve 22*b* with that portion of the developer which has not been transferred from the developing magnet roller 22 to the transfer magnet roller 23**.

The scraper **29*a* is provided at an upper part of the separator 29 as shown in FIG. 6 and may be a part of the separator 29 or independent thereof. The scraper 29*a* has a tip with an acute angle so as to be able to scrape off the developer magnetically attracted to and attached on the transfer magnet roller 23. For this purpose, the tip is disposed adjacent to the surface of the sleeve 23*b* with a gap on the order of 0.2 mm therebetween. The gap between the separator 29 and the transfer magnet roller 23** is on the order of 0.5 mm.

The tip of the scraper **29*a* is within the area where the brush-like formation of the developer is maintained on the sleeve 23*b* as explained above. In other words, the magnet piece 23*a* is designed such that the tip of the scraper 29*a* is within the angular range on the sleeve 23*a*** where the developer particles maintain the brush-like formation.

If the magnetic force of the developer release magnetic pole S23 is 500 gauss as described above, the area on which the brush-like formation of the developer particles can be maintained subtends about ±10° from the position of the pole S23. Thus, the pole S23 is formed such that the tip of the scraper **29*a*** falls within this angular range which covers this area.

The position of the developer release magnetic pole S23 is not limited by that of the tip of the scraper **29*a* because, for example, the area over which the brush-like formation of the developer particles is maintained becomes large if the magnetic force of the pole S23 is increased. In other words, it may be permissible, under certain conditions, that the tip of the scraper 29*b*** be positioned outside the angular range mentioned above.

As shown in FIG. 6, the upper surface of the scraper **29*a* is sloped downward from its tip opposite the transfer magnet roller 23 to its back end part adjacent to the second stirring roller 25. For the convenience of stirring the developer, the back end part of the scraper 29*a* extends farther from the separator 29. The first stirring roller 24 is disposed near this sloping upper surface of the scraper 29*a* and serves to stir and mix together the toner supplied from the container 20 and the developer particles scraped off by the scraper 29*a***.

The separator 29 has circularly arcuate surfaces 32 and 33, as shown in FIG. 1, opposite respectively to the transfer magnet roller 23 and to the second stirring roller 25, forming small gaps respectively with the sleeve 23*b* and the shutters 38 of the shutter system 35. A portion of the inner wall of the developer tank of the developing unit 4 is similarly rounded opposite to the shutter system 35 so as to form a narrow gap therebetween.

In FIG. 1, numeral 64 indicates a developer channel formed between the separator 29 and the inner wall of the developer tank of the developing unit 4 and between the first stirring roller 24 and the second stirring roller 25. Numeral 65 indicates another developer channel formed between the first stirring roller 25 and the developing magnet roller 22. These channels 64 and 65 are opened or closed by the rotary motion of the shutter system 35. By thus controlling the quantity of developer supply to the developing magnet roller 22, it is possible to selectably set the developing unit 4 either in the developing condition or in the non-developing condition.

At a lower position in the developer channel 65, there is disposed a toner density sensor 28 for detecting the toner density of the developer coming into this channel 65. Below the toner density sensor 28 in the developer channel 65 is a doctor blade 27 disposed with a gap maintained with the sleeve 22*b* of the transfer magnet roller 22.

With reference next to FIG. 2 with the developing units 4–7 structured as described above, the driving rollers 1 and 2 begin to rotate at a fixed speed in the directions shown by the arrows C and D if a copy switch is operated. This causes the upper part of the photoconductor 3 to move in the direction of the arrow E. After the photoconductor 3 is evenly charged by the main charger 12, an electrostatic latent image is formed by exposure to light from the exposing device 19. This latent image is developed to form a toner image by attaching toner particles thereonto while the developing units 4–7 are in the developing condition.

The toner image thus formed is moved in the direction of the arrow E together with the motion of the photoconductor 3 and is transferred onto the intermediate transfer belt 11 by means of the first transfer charger 13. Next, the toner image transferred onto the intermediate transfer belt 11 is further transferred by means of the second transfer charger 15 onto a copy paper sheet 14 fed from one of the paper feeders 17 and is then fixed by the fixing device 18.

The operations inside the developing units 4–7 when an electrostatic latent image is developed on the photoconductor 3 are explained next.

With reference again to FIG. 1, the first stirring roller 24 serves to stir and mix together the toner supplied from the container 20 and the developer particles transferred by the transfer magnet roller 23.

During this operation, the developing unit 4 is in the developing condition and the rotationally movable parts of the shutter system 35 around the second stirring roller 25 are preliminarily so positioned that the slit-like apertures 63 are opposite to the developer channels 64 and 65. Thus, the developer which has been stirred by the first stirring roller 24 and reached the second stirring roller 25 through the channel 64 is supplied to the developing magnet roller 22 through the shutter system 35 and the channel 65, after being further stirred by the second stirring roller 25.

As the developer particles pass through the channel 65, the toner density therein is detected by the toner density sensor 28. If the toner density thus detected is below a predetermined threshold value, a new supply of toner is received from the container 20.

The rate at which the developer passes through the channel 65 is controlled such that an appropriate amount of developer sticks to the sleeve 22*b* according to the gap between the sleeve 22*b* and the doctor blade 27. The developer particles attaching to the sleeve 22*b* move downward with the rotation of the sleeve 22*b* indicated by the arrow A and reach the vicinity of the pole N11 of the magnet roller 22.

In the vicinity of the pole N11, a brush-like formation of developer particles is formed along the magnetic field lines. As this brush-like formation of developer particles contacts the photoconductor 3 slidably thereover, only the toner particles therein are attached to the charged areas on the photoconductor 3, thereby developing the latent image thereon.

The part of the developer particles remaining on the sleeve 22*b* moves upward as the sleeve 22*b* continues to rotate and approaches the transfer magnet roller 23. Near the transfer magnet roller 23, the developer particles make a brush-like formation along the magnetic force lines due to the pole N11. As the sleeve 22*b* rotates further on, the magnetic force lines due to the pole S come to more strongly affect the developer particles because the magnetic force of the pole S is made stronger than that of the pole N12 on the magnet piece 22*a*. As a result, the developer particles are magnetically attracted by the sleeve 23*b* of the transfer magnet roller 23 so as to make a brush-like formation on the surface of the sleeve 23*b* and move upward as the sleeve 23*b* rotates as shown by the arrow B.

The direction of developer flow changes within the space roughly surrounded by the developing magnet roller 22, the transfer magnet roller 23 and the separator 29 but, since the gap d between the sleeve 22*b* of the developing magnet roller 22 and the separator 29 is greater than the thickness of the layer of developer not transferred to the transfer magnet roller 23 and since the developer pressure is released from the gap, the developer pressure cannot increase excessively.

Thus, developer particles transferred up to the position of the pole N12 by the rotation of the sleeve 22*b* are effectively transferred to the sleeve 23*b* of the transfer magnet roller 23. These developer particles are transferred and circulated smoothly without generating any excessive stress. The quality deterioration of the developer in early stage of the operation usually caused by an excessive stress thereon during a transfer process can thus be avoided substantially.

The developer particles attaching to the sleeve 23*b* of the transfer magnet roller 23, on the other hand, are further transferred upward to the vicinity of the pole N22 as the sleeve 23*b* rotates as shown by the arrow B. The angular separation between the poles N22 and S23 is such that the brush-like formation of the developer particles is maintained not only near these poles N22 and S23 but also over a relatively large area therebetween. Thus, developer particles can be effectively scraped off by the tip of the scraper 29*a* as the sleeve 23*b* rotates.

When the developer particles magnetically attracted to the sleeve 23*b* reach the position of the developer release magnetic pole S23, they are in a brush-like formation by the magnetic force of the pole S23. The gap between the scraper 29a and the sleeve 23b becomes filled with this brush-like formation and practically all developer particles being transferred by the sleeve 23b can be dependably scraped off instead of passing through this gap. As the developer particles which have been scraped off by the scraper 29a move down along the sloped upper surface of the scraper 29a, they are stirred and mixed by the first stirring roller 24 with the toner particles supplied from the containers 20. The sequence described above is repeated to circulate developer particles and the electrostatic latent image formed on the photoconductor 3 is developed.

After the electrostatic latent image formed on the photoconductor 3 is developed as explained above, the developing unit 4 is put in the non-developing condition such that toner particles do not stick to the photoconductor 3 and a different one of the developing units 5–7 can be set in the developing condition. This is carried out by means of the shutter system 35 and the selector 36 as will be explained in detail below. For this purpose, the solenoid 44 of the selector 36 shown in FIG. 5 is energized such that the plunger 44b moves backward against the elastic force of the spring 45, causing the arm 43 to rotate in the direction of the arrow P and releasing the engagement of the stopper 49 with the claw piece 40b. In summary, the clutch cover 40 shown in FIG. 3 is capable of rotating together with the protuberant part 46, causing the protuberant part 46 and the axially extended part 62a to be tightened by the coil sprint 47. Thus, the rotary force from the central axis 30 to the protuberant part 46 is transmitted to the flange 62 through the coil spring 47 and the extended part 62a, causing the axially extended part 62a and the shutter system 35 to rotate also.

The solenoid 44 is switched off immediately after the clutch cover 40 begins to rotate, causing the arm 43 to rotate by the elastic force of the spring 45 in the direction of the arrow Q shown in FIG. 5. When the clutch cover 40 has rotated about 90°, it is stopped as the claw piece 40c of the clutch cover 40 comes to engage with the stopper 49. Thus, the force of the coil spring 47 becomes weaker around the parts adjacent to the outer periphery of the protuberant part 46 and motion is not communicated any longer from the protuberant part 46 to the flange 62, causing the rotary motion of the shutter system 35 to stop. In other words, the shutter system 35 stops after it rotates with the clutch cover 40 by about 90°, closing the channels 64 and 65 by means of the shutters 38.

As a result, the developer particles which are stirred by the first stirring roller 24 are prevented from reaching the developing magnet roller 22, those particles magnetically attracted onto the developing magnet roller 22 are eventually transferred by the transfer magnet roller 23, and then the rollers 22–25 stop turning. The brush-like formation of the developer particles disappears and the photoconductor 3 cannot be developed. The developing device is now in a stand-by condition.

When the developer channels 64 and 65 are closed by the shutter system 35, the rotational position detector switch 53 is turned off because its movable piece (briefly mentioned above) is not pressed by either of the sheet-like protrusions 40f and 40g, and it is detected by means of a controller (not shown) that the developing device is not in the developing condition.

When the developing device in the stand-by condition is started again, the solenoid 44 is energized and the shutter 38 is rotated about 90° through the spring clutch 39, allowing developer particles to be supplied to the developing magnet roller 22 through the channels 64 and 65 and through the slit-like apertures 63. A brush-like formation of the developer particles is formed and the photoconductor 3 is ready to be developed.

Figure 8:
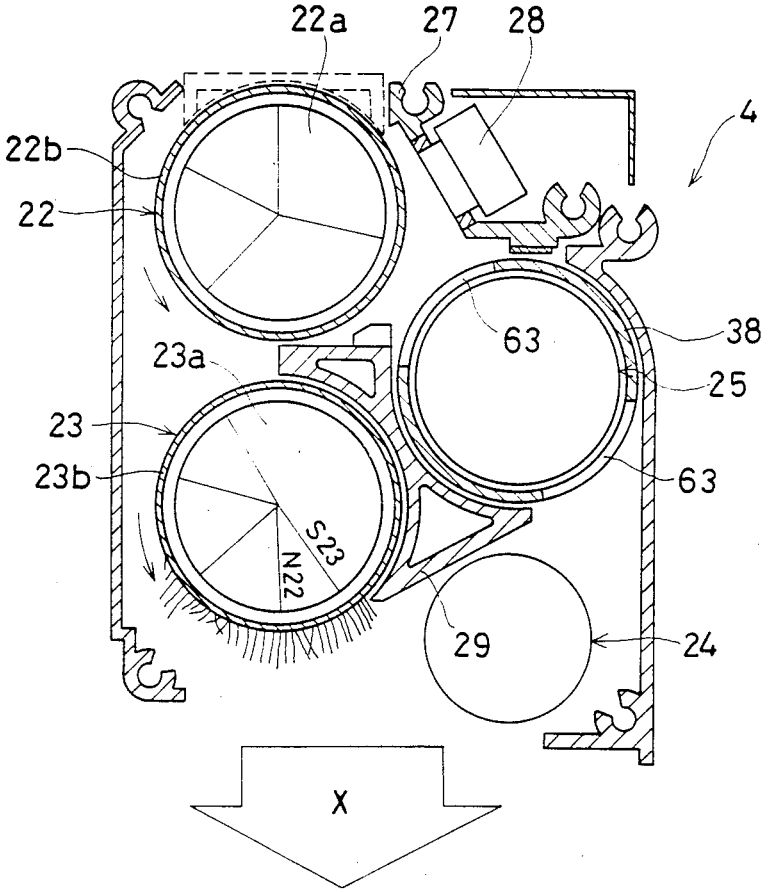
FIG. 8 is a vertical sectional view of the developing unit of FIG. 1 when the unit is upside down for removing the developer particles therein.

The procedure for removing developer particles from the developer tank and to replace them with a fresh supply is explained next with reference to FIG. 7 and FIG. 8.

Initially, the container 20 is removed from the developer tank. The developer tank has an upper lid 4a as shown in FIG. 1 and this upper lid 4a of the developer tank is removed next such that the top of the developer tank is left open. The developer tank is put in an upside down orientation as shown in FIG. 8 and the sleeve 22b of the developing magnet roller 22 is rotated together with the sleeve 23a of the transfer magnet roller 23 in the directions of the arrows in FIG. 8.

The developer particles remaining in the part of the developer tank where development takes place are attracted by the developing magnet roller 22, transferred by the transfer magnet roller 23 and discarded through the upper opening (now at the bottom because the tank is in an upside down orientation) as schematically shown by the arrow X. A large amount of developer particles is in a brush-like formation between a relatively wide area between the poles S23 and N22, the developer particles transferred by the transfer magnet roller 23 are efficiently scraped off by the tip of the scraper 29a and dropped off. This procedure for removing used developer particles can be carried out smoothly and easily if the magnetic force of the poles S23 and N22 is relatively weak, say, below 500 gauss.

As explained above, the transfer magnet roller 23 is disposed above the developing magnet roller 22 such that the developing units 4–7 can be made compact by reducing their widths and the developer can be circulated smoothly. Moreover, the magnetic force of the pole S is greater than that of the pole N12 such that the developer particles attracted by the developing magnet roller 22 can be efficiently transferred to the transfer magnet roller 23.

The present invention is further characterized in that, as developer particles are transferred from the developing magnet roller 22 to the transfer magnet roller 23, the pressure due to the change in the direction of transfer is released from the gap between the sleeve 22b of the developing magnet roller 22 and the separator 29. Thus, the stress on the developer particles in the space enclosed by the developing magnet roller 22, the transfer magnet roller 23 and the separator 29 is reduced and their quality deterioration at early stage can be dependably avoided.

Since the gap between the scraper 29a and the sleeve 23b becomes filled with the brush-like formation of developer particles formed by the pole S23, furthermore, the developer particles transferred by the transfer magnet roller 23 are dependably scraped off by the scraper 29a without passing into the gap.

Moreover, since a brush-like formation of developer particles is formed continuously over a relatively wide area between the poles S23 and N22, it is possible to scrape off a large amount of developer particles efficiently by the scraper 29a.

Thus, the developer particles supplied over again to the developing magnet roller 22 from the transfer magnet roller 23 are not significantly stressed and their quality deterioration at early stage can be reduced. In other words, the useful life of the developer particles can be significantly improved.

When the developer particles inside the tank are to be removed and replaced with a new supply, the work can be carried out smoothly, easily and efficiently because a large amount of used developer particles form a brush-like formation between the poles S23 and N22.

This invention has been described above by way of a single embodiment but it is not intended to limit the scope of the invention. Many variations and modifications are apparently possible within the spirit of the present invention and such variations and modification that may be apparent to people skilled in the art are intended to be included within the scope of this invention. For example, the developing magnet roller 22 and the transfer magnet roller 23 need not be vertically arranged as shown, for example, in FIG. 1. The number of magnetic poles and their arrangement are not required to be exactly as described. The photoconductor 3 need not be belt-like but may be shaped like a drum. The number of the developing units need not be as illustrated. The width of the shutters 38 in the shutter system 35 was shown to be greater than the distance between the inner wall of the developer tank and the separator 29 such that the developer leakage to the developing magnet roller 22 can be prevented.

We claim:

1. A developing device for an electrophotographic apparatus, said device comprising:

a developing magnet roller having a sleeve around a columnar magnet piece and being disposed opposite a photoconductor capable of having an electrostatic latent image formed thereon, said sleeve being adapted to rotate around said magnet piece in a specified direction, a transfer magnet roller disposed adjacent said developing magnet roller for receiving used developer from said developing magnet roller and transferring said received developer away from said developing magnet roller, and a separator disposed between said developing magnet roller and said transfer magnet roller for separating said developing magnet roller from said transfer magnet roller, a gap being formed between said separator and said sleeve of said developing magnet roller, said gap being greater than the thickness of the layer of developer not transferred to said transfer magnet roller and remaining on said sleeve of said developing magnet roller, said developer not transferred passing through said gap downward along said specified direction.

2. The developing device of claim 1 wherein said transfer magnet roller includes another sleeve rotatably around another magnet piece.

3. A developing device for an electrophotographic apparatus, said device comprising:

a developing magnet roller disposed opposite a photoconductor capable of having an electrostatic latent image formed thereon, a transfer magnet roller disposed adjacent said developing magnet roller for receiving used developer from said developing magnet roller and transferring said received developer away from said developing magnet roller, and a scraper with a tip for scraping off said developer from said transfer magnet roller, said transfer magnet roller having a magnet piece with a cylindrical outer peripheral surface and a sleeve rotatably fitted around said outer peripheral surface, said magnet piece having a developer release magnetic pole on said outer peripheral surface, said developer release magnetic pole having a magnetic force of less than 500 gauss and defining a brush-forming area on said sleeve where a brush-like formation of said developer is formed by said magnetic force of said developer release magnetic pole, said tip of said scraper being positioned adjacent to said sleeve and opposite said brush-forming area.

4. The developing device of claim 3 wherein said tip is positioned at an angular position within $\pm 10°$ of said developer release magnetic pole with respect to said cylindrical outer peripheral surface of said transfer magnet roller.

5. A developing device for an electrophotographic apparatus, said device comprising:

a developing magnet roller disposed opposite a photoconductor capable of having an electrostatic latent image formed thereon, and a transfer magnet roller disposed adjacent said developing magnet roller for receiving used developer from said developing magnet roller and transferring said received developer away from said developing magnet roller in a specified direction around said transfer magnet roller, said transfer magnet roller having a magnet piece with a cylindrical outer peripheral surface, said magnet piece having a developer release magnetic pole and a developer transfer magnetic pole on said outer peripheral surface, said developer release magnetic pole being removed downstream from said developer transfer magnetic pole with reference to said specified direction, said developer release magnetic pole and said developer transfer magnetic pole each having a magnetic force of less than 500 gauss.

6. The developing device of claim 5 wherein the angular separation between said developer release magnetic pole and said developer transfer magnetic pole with reference to said cylindrical outer peripheral surface is less than 40°.

* * * * *